US006166342A

United States Patent [19]

Chou

[11] Patent Number: 6,166,342

[45] Date of Patent: Dec. 26, 2000

[54] PUSHBUTTON IN KEYBOARD (2)

[75] Inventor: Chin-Wen Chou, Taipei, Taiwan

[73] Assignee: Shin Jiuh Corp., Taipei Hsein, Taiwan

[21] Appl. No.: 09/437,484

[22] Filed: Nov. 10, 1999

[30] Foreign Application Priority Data

Aug. 30, 1999 [CN] China ..... 88214716

[51] Int. Cl.[7] ..... H01H 5/00

[52] U.S. Cl. ..... 200/344

[58] Field of Search ..... 200/341–345, 200/292

[56] References Cited

U.S. PATENT DOCUMENTS 5,438,177 8/1995 Fagan ..... 200/517

*Primary Examiner*—Michael L. Gellner
*Assistant Examiner*—Nhung Nguyen
*Attorney, Agent, or Firm*—Bacon & Thomas, PLLC

[57] ABSTRACT

An improved positioning structure of pushbutton in keyboard (2) comprises a base, a printed circuit board (PCB) attached on the base having a plurality of pivot-jointing portions protrusively disposed on its surface for defining a plurality of enclosed assembly-jointing sections, a link (bridge) disposed at the assembly-jointing section having a movable shaft axially jointed with the pivot-jointing portion, an elastomer arranged on the link, and a key cap disposed on the elastomer being coupled with a positioning shaft at one end of the link. By assembling the abovesaid components, a waterproof and thinner keyboard at lower cost is realizable.

7 Claims, 9 Drawing Sheets

PUSHBUTTON IN KEYBOARD (2)

BACKGROUND OF THE INVENTION

1. Field of the Invention

This invention relates to an improved structure of pushbutton in keyboard, more particularly, to a pushbutton containing a link (bridge) jointedly disposed on a printed circuit board directly for building a lower cost waterproof keyboard in thinner thickness.

2. Description of the Prior Art

The structure of an existing keyboard shown in FIG. 1 mainly comprises a key cap, an elastomer, a link (bridge) laid surrounding the elastomer, a plastic assembly-jointing board made by injection molding, a membrane printed circuit board (abbreviated as PCB hereinafter), and a base underneath the PCB, wherein the assembly-jointing board is pressed out to form a pivot-jointing portion on its surface for pivotally jointing with a movable shaft of the link; and a key cap is combinably jointed onto the link to complete a known structure of keyboard.

Another type of keyboard structure is shown in FIG. 2. The keyboard comprises a key cap, an elastomer, a link, a membrane circuit board, and a base, wherein the base is pressed out to form a plurality of pivot-jointing portions on its surface for pivotally jointing the link. When assembling, the procedure is to overlap the membrane circuit board on the base firstly, then, position and fix the elastomer, pivotally joint a movable shaft of the link to the pivot-jointing portion, and finally, combinably joint the key cap on the link to complete a keyboard.

The defects of the foregoing keyboard may be summarized as the following:

1. For pivotally jointing the link, the assembly-jointing board or the base must be pressed out to form a plurality of pivot-jointing portions at certain height that thickens the keyboard and increases the production cost due to the additional pressing process.

2. As the base is a metallic rigid body, the movable shaft may be deformed or ruptured when it is to pivotally joint the link with the pivot-jointing portion to result in waste of resources occasionally.

3. After use in a long-term period, the movable shaft of the link and the pivot-jointing portion of the metallic base fret each other frequently to create metal dust that can possibly drop on the PCB to incur a short circuit or a malfunction.

4. As two printed circuit layers of abovesaid membrane PCB and an insulation layer are overlapped merely, the space therein keeps open without sealing, and when the elastomer is pressed downwards while a user happens to drip a water drop down to the keyboard, the water drop will be sucked into the inlayers through clearance in the PCB as soon as the elastomer is released due to a vacuum suction effect, which may result in a short circuit.

In view of the above imperfections, this invention is proposed to form a pivot-jointing portion on a PCB directly by extrusion for pivotally jointing a movable shaft of a link in order to provide a lower cost, thinner, waterproof keyboard.

SUMMARY OF THE INVENTION

The primary object of this invention is to provide a pivot-jointing portion formed directly on a PCB by extrusion for pivotally jointing a movable shaft of a link (bridge) to save the prior high cost and complicated process in pressing and forming a base or an assembly-jointing board and shorten height of keyboard.

Another object of this invention is to provide both a PCB and a pivot-jointing portion thereon made of an elastic material, so that a movable shaft won't be deformed or ruptured when jointing despite whether a link is rigid or elastic, and the metal dust won't be produced even after use in a long term period for keeping the circuit board clean to avoid any short circuit.

A further object of this invention is to provide a lifetime prolonged waterproof keyboard by sealing printed circuit layer and insulation layer together for moisture resistance.

BRIEF DESCRIPTION OF THE DRAWINGS

For a better understanding to the present invention, together with further advantages or features thereof, at least one preferred embodiment will be elucidated below with reference to the annexed drawings in which.

DETAILED DESCRIPTION OF THE PREFERRED EMBODIMENT

Figure 1:
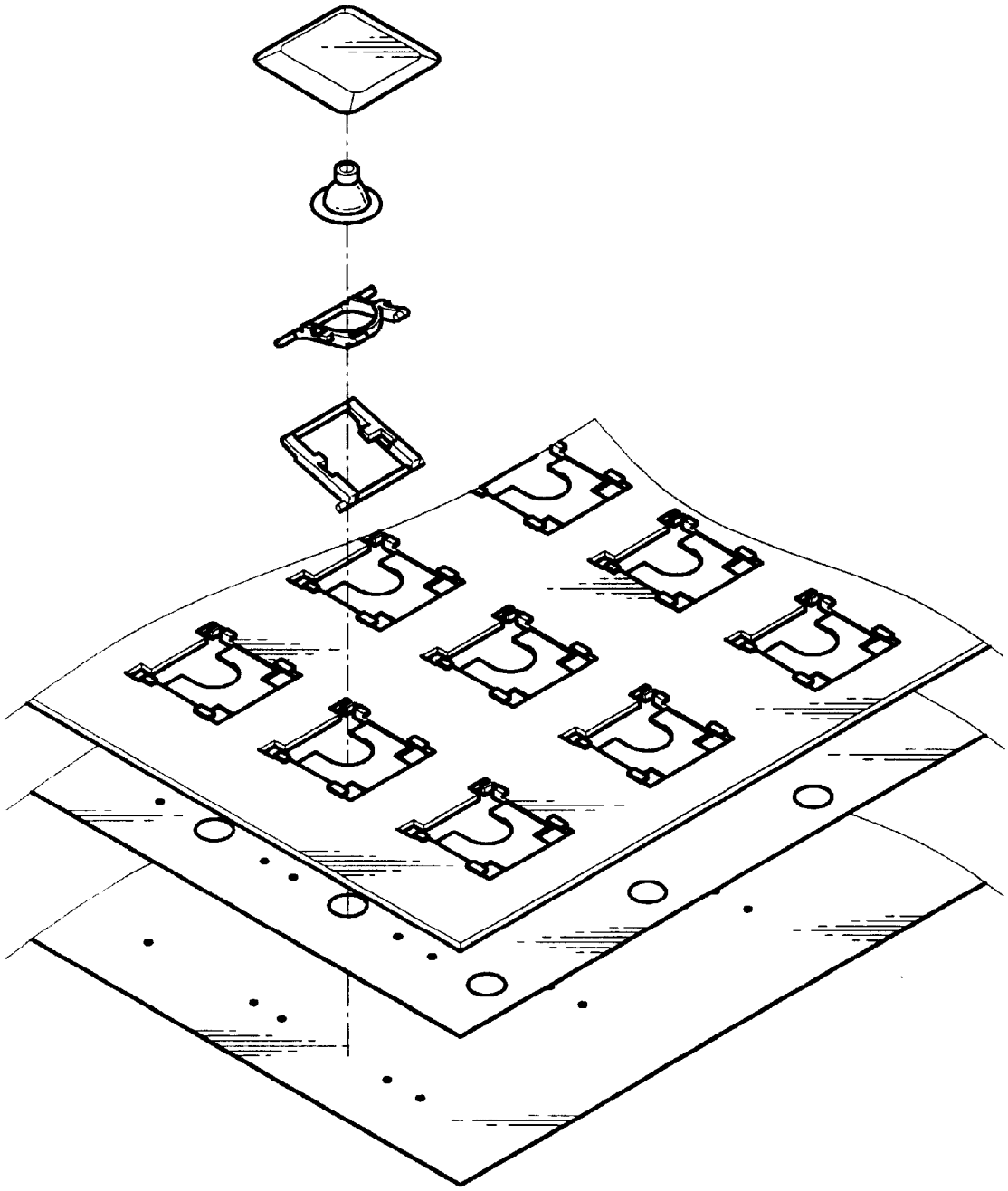
Fig. 1 PRIOR ART
FIG. 1 is a schematic view showing structure of a prior keyboard.
Figure 2:
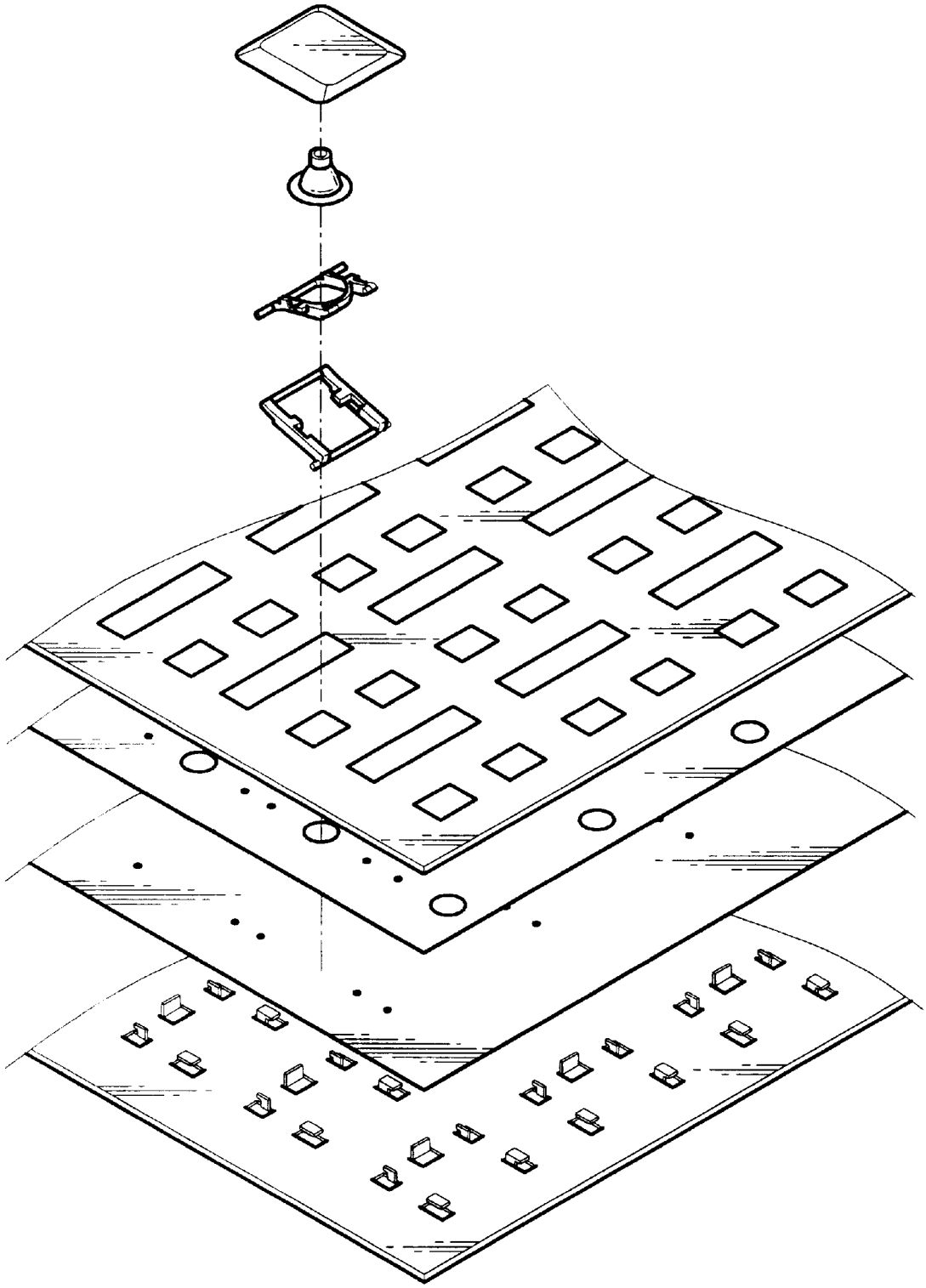
Fig. 2 PRIOR ART
FIG. 2 is a schematic view showing structure of another prior keyboard.
Figure 3:
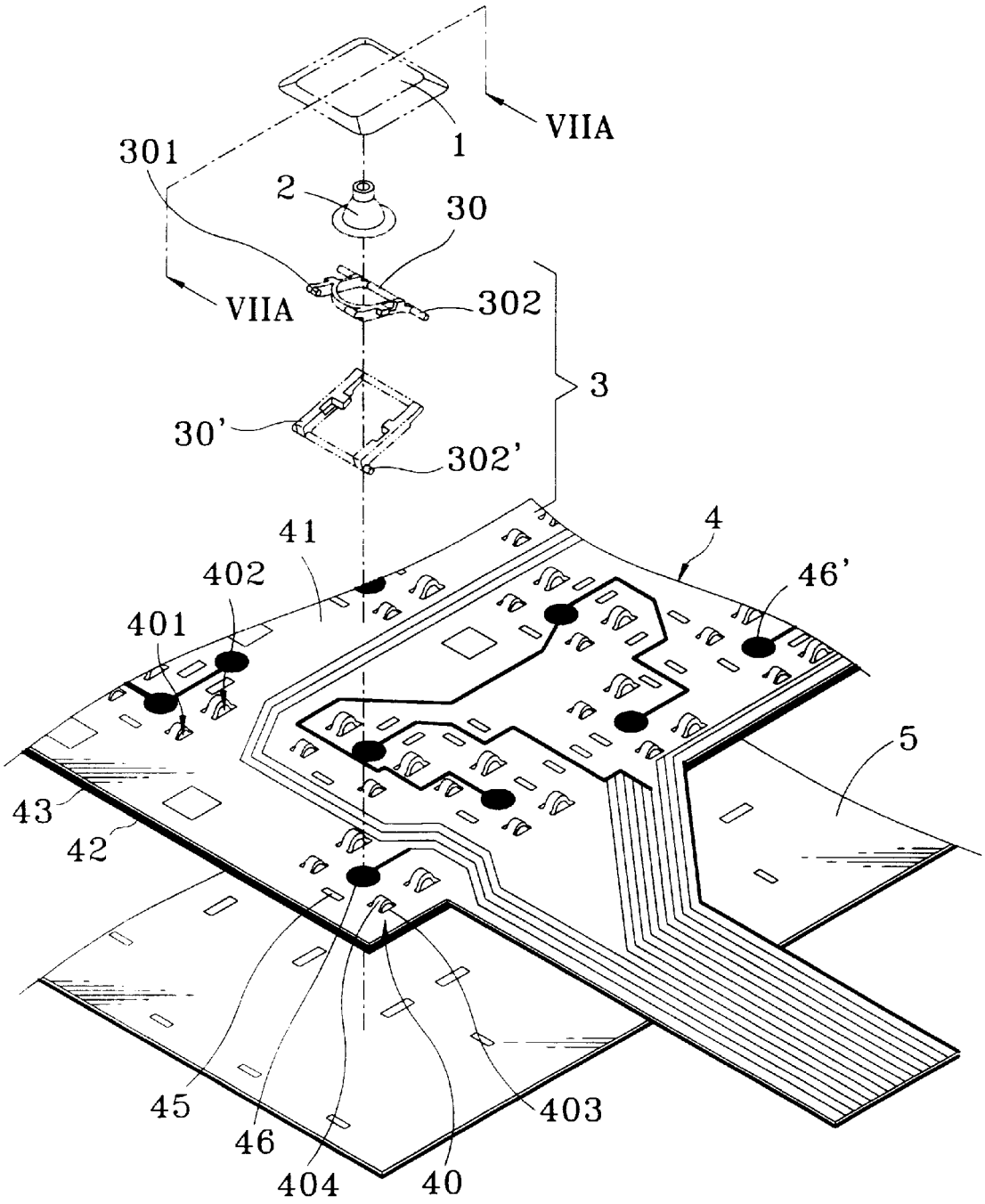
FIG. 3 is a structural exploded view showing a keyboard of this invention.
Figure 7A:
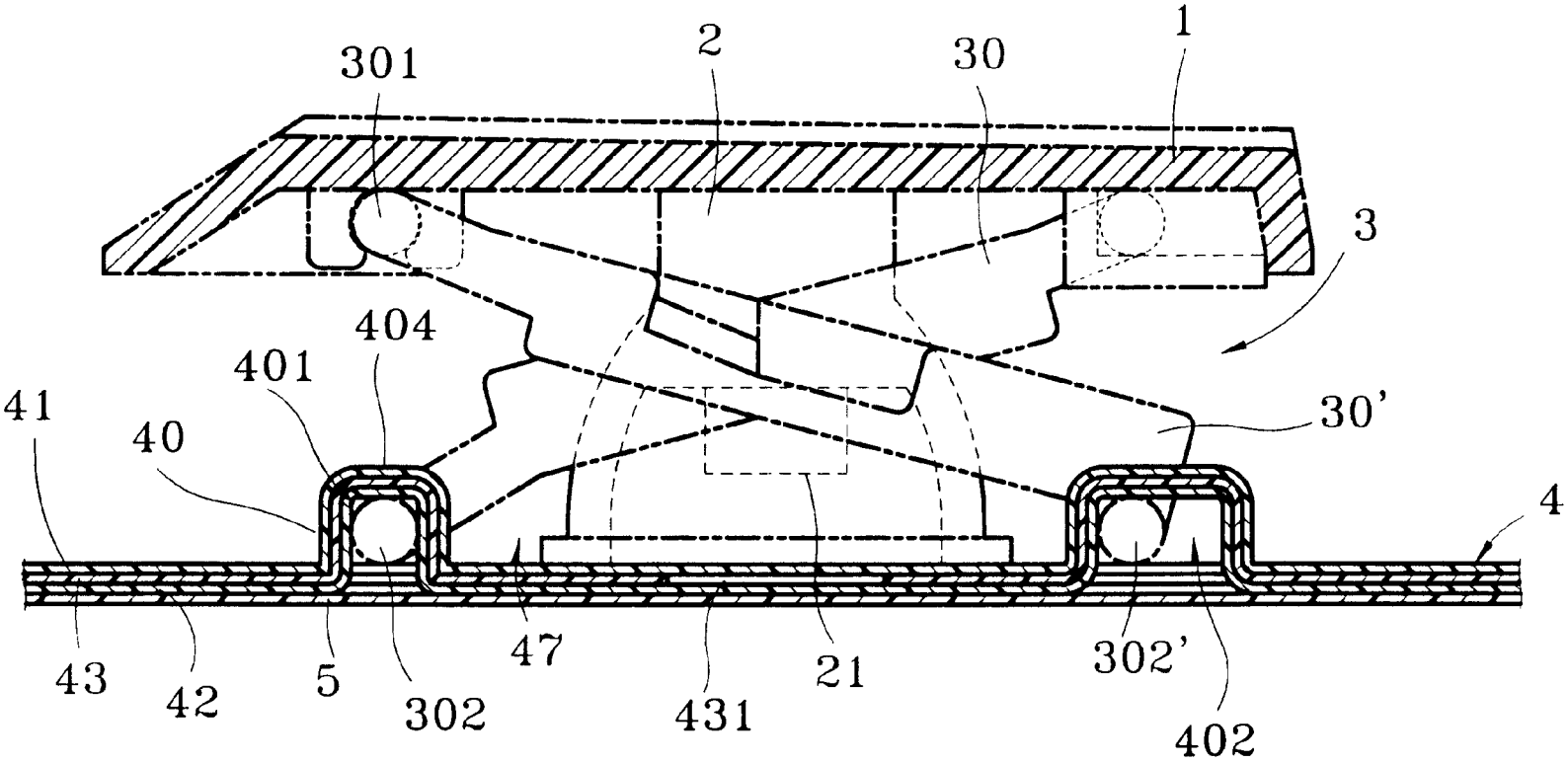
FIG. 7A is a vertical sectional view after assembling taken along line VIIA—VIIA in FIG. 3.

As shown in FIGS. 3 and 7A—a structural exploded view and a vertical sectional view—this invention comprises a base 5 made in metal or hard plastics, a PCB 4 (printed circuit board) attached on the base 5 having a plurality of pivot-jointing portions 40 protrusively disposed on its surface for defining a plurality of enclosed assembly-jointing sections 47, a link (bridge) 3 disposed on the assembly-jointing section 47 of the PCB 4 having a movable shaft 302, 302' at its ends axially jointed with the pivot-jointing portion 40, a elastomer 2 combinably mounted on the link 3, and a key cap 1 combinably mounted on top of the elastomer 2 and coupled with a positioning shaft 301 at end of the link 3; and by assembling abovesaid components, a lower cost and thinned waterproof keyboard can be realized.

The link 3 contains two frame bodies 30, 30' formed in axis-jointing or pivot-jointing manner, wherein the positioning shaft 301 and the movable shaft 302, 302' disposed at an upper and a lower end of the link 3 are combinably jointed with the key cap 1 and pivotally mounted on the PCB 4 respectively. (As the axis-jointing or pivot-jointing manner of the link 3 made in different materials is already well known and is not much concerned with the structure of this invention, therefore, it won't be repeatedly emphasized or elucidated in this text.)

Figure 4:
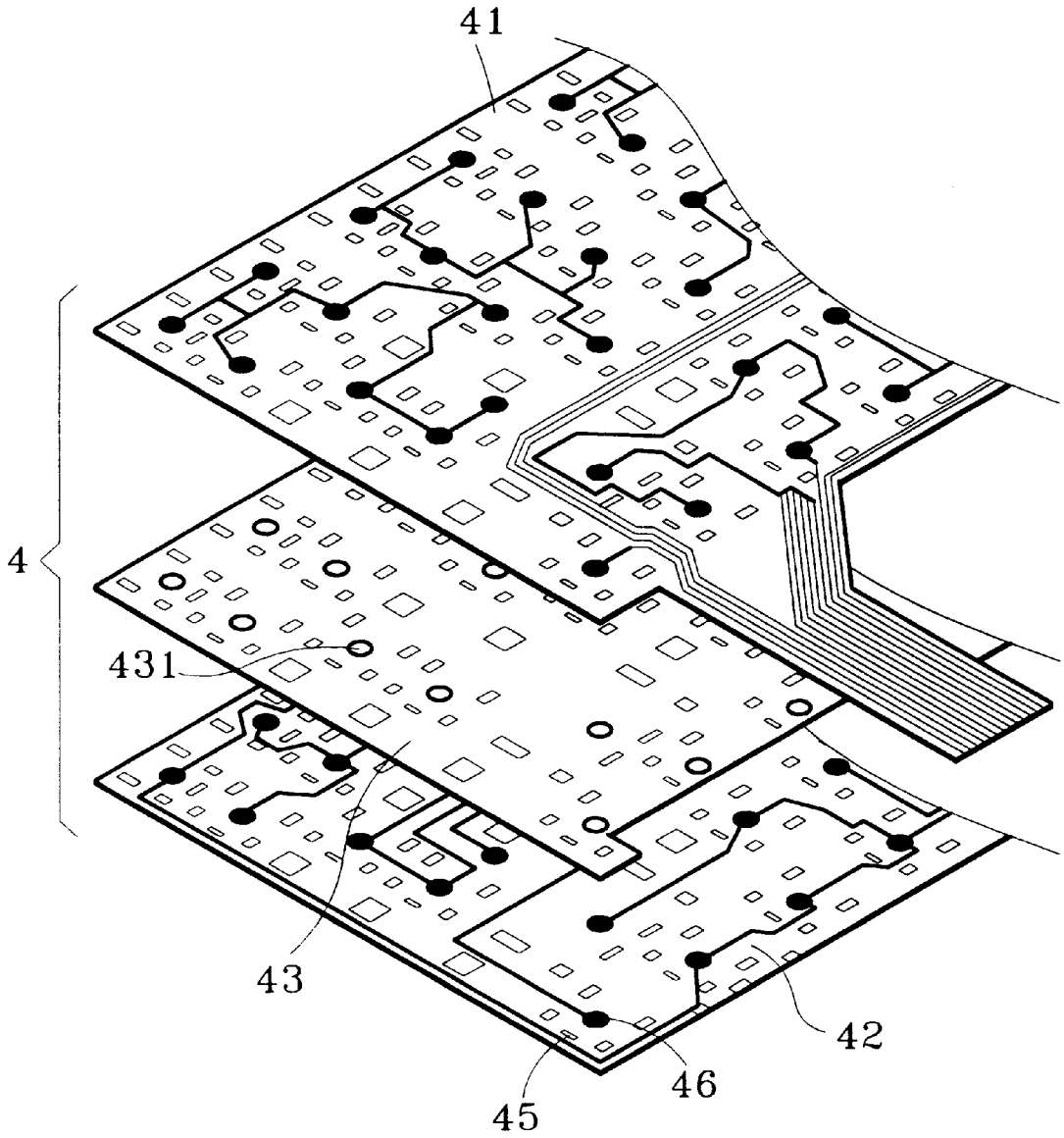
FIG. 4 is an exploded view of a PCB of this invention before processing.

The PCB 4—a membrane printed circuit board widely used in electronic industry—comprises a first printed circuit layer 41, a second printed circuit layer 42, and an insulating partition layer 43 interposed between the first and the second printed circuit layer 41, 42. (The insulating partition layer 43 may be made by printing a Mylar film or laying glued films directly depending on circuit design of contact points. Only the Mylar film serving for the insulating partition layer 43 will be elucidated in the embodiment below.) As shown in FIG. 4, a plurality of contact points 46, 46' is disposed respectively on the first and the second printed circuit layer 41, 42 in amount and position corresponding to the pushbutton of the keyboard. Also, a plurality of through holes 431 is formed in the insulating partition layer 43 corresponding to the contact points 46, 46' in the first and the second printed circuit layer 41, 42. The mentioned pivot-jointing portion 40 is formed by cutting two predetermined cutting lines 403 marked on the trinity of the first and the second printed circuit layer 41, 42 and the insulating partition layer 43 to define a piece body 404 before extruding. And, in the process of forming the piece body 404 by applying heat treatment, ultrasonic, hydraulic technique or the equivalent, a pivot-jointing hole 401, 402 will be created simultaneously. Moreover, each set of the pivot-jointing portion 40 is formed by cutting the predetermined cutting lines 403 in different lengths on the PCB 4 for defining the piece body 404 which is then extruded to form the pivot-jointing hole 401, 402 and define an enclosed assembly-jointing section 47. Consequently, the movable shaft 302 at one end of the link 3 is supposed to be pivotally mounted in the pivot-jointing hole 401 with a relatively shorter inner diameter, while the movable shaft 302' at the other is pivotally mounted in the pivot-jointing hole 402 with a longer inner diameter and is slidable with respect to the movable shaft 302. (The size of inner diameter of the pivot-jointing hole 401, 402 must be adjusted for matching action mode of the link 3, that is, those two pivot-jointing holes 401, 402 may happen to be identical.)

Figure 5:
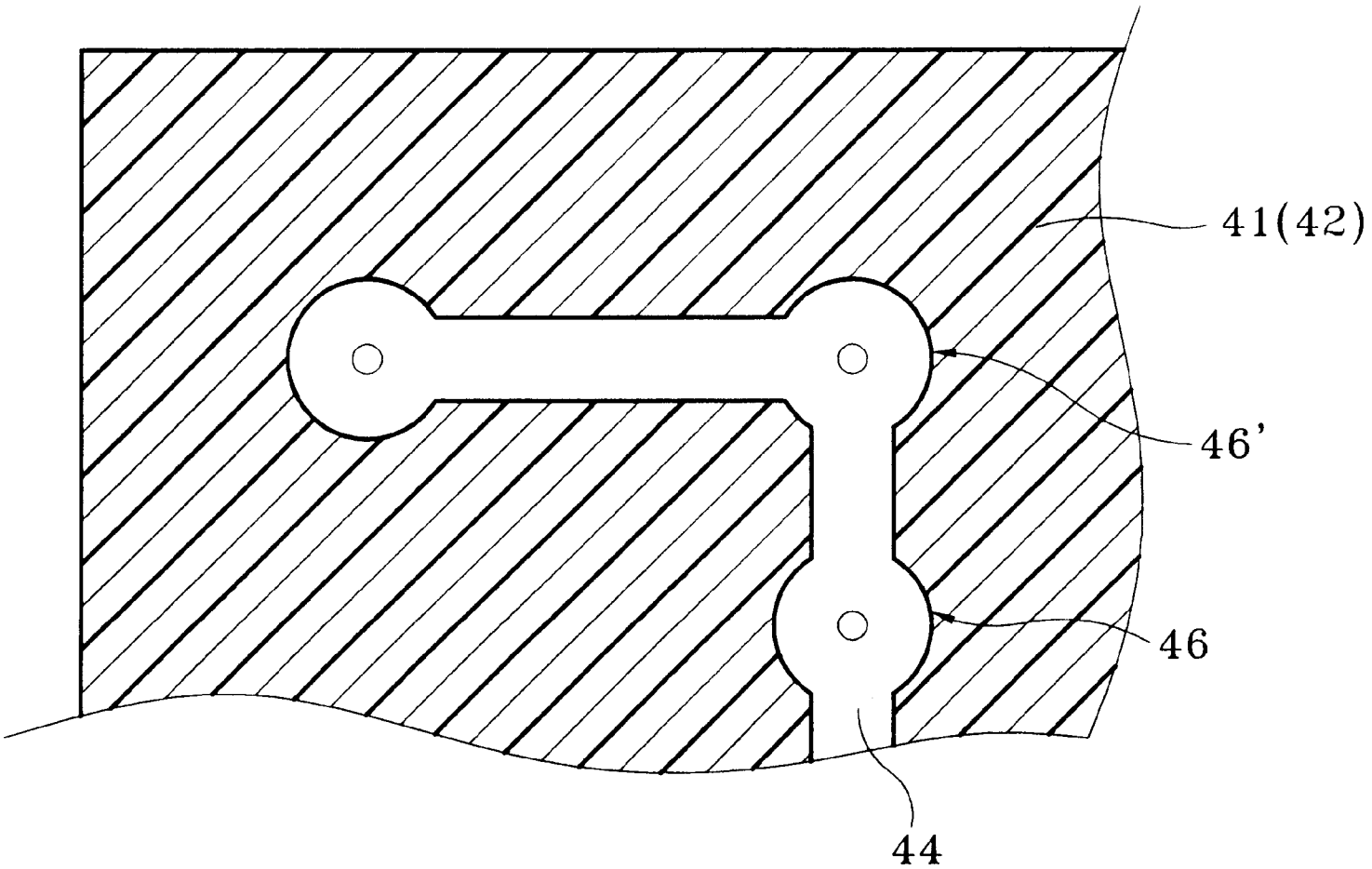
FIG. 5 is an assembled view of the PCB of this invention after processing.
Figure 6:
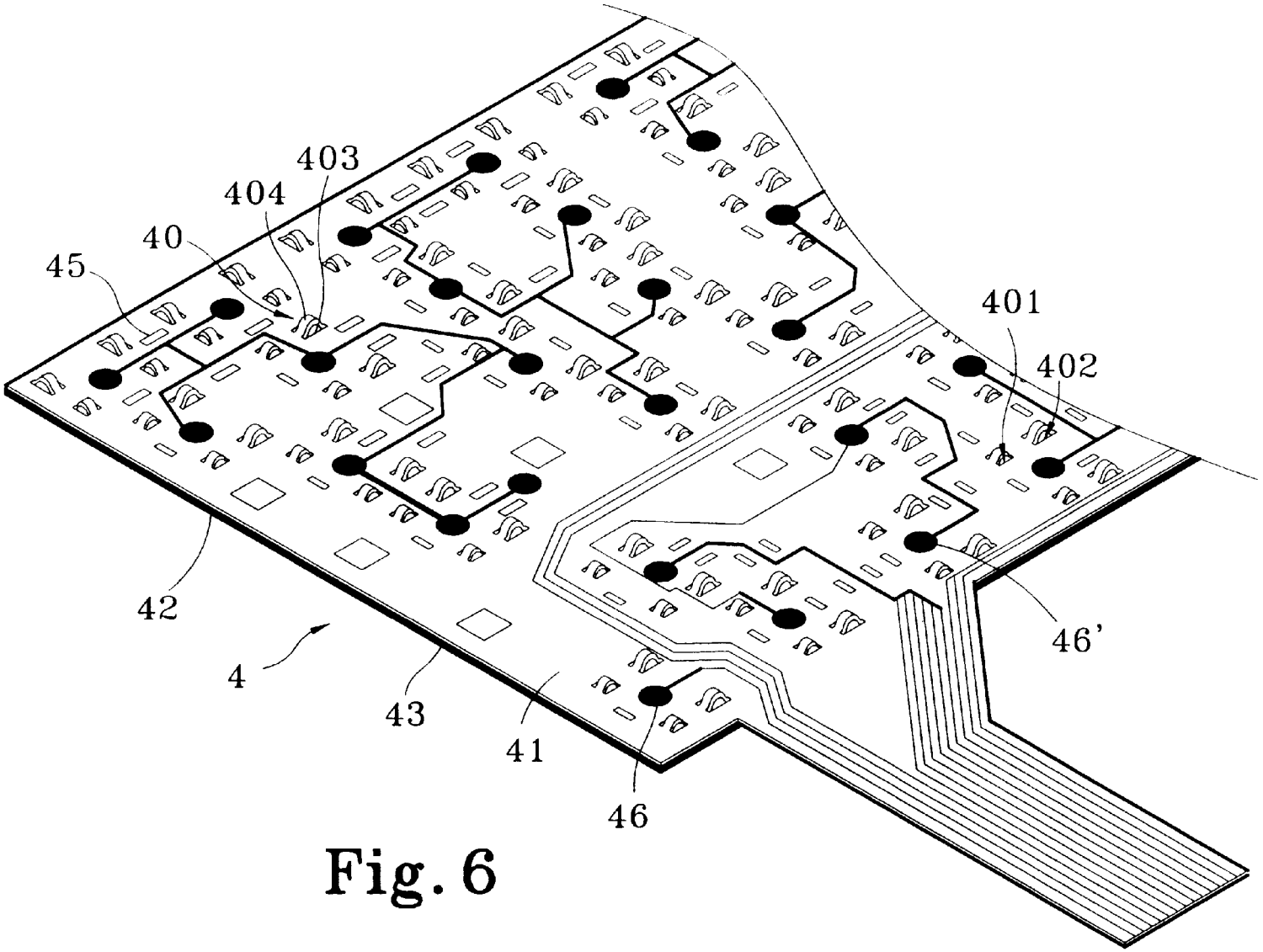
FIG. 6 is a schematic view showing air channel in the PCB of this invention.

As shown in FIGS. 4 and 5, the first printed circuit layer 41, the insulating partition layer 43, and the second printed circuit layer 42 are to be combined and sealed by printing and gluing for preventing intrusion of moisture except some predetermined sections reserved between the contact points 46, 46' in the first and the second printed circuit layer 41, 42 for forming a plurality of air channels 44, which is further provided with a plurality of heat dissipation holes 45 laterally in order to dissipate the heat produced during operation.

Referring to FIG. 3, the PCB 4 having a plurality set of the pivot-jointing portion 40 and the heat dissipation holes 45 formed therein is adhered on the base 5, then, the movable shaft 302 at one end of the link 3 is pivotally mounted in the relatively smaller pivot-jointing hole 401, and the movable shaft 302' at the other is pivotally mounted in the larger pivot-jointing hole 402. The next step is to dispose the elastomer 2 on the link 3, and before doing so, glue may be applied on peripheral annular zone of the contact points 46, 46' on the circuit board, so that bottom face of the elastomer 2 can be adhered without offset during operation; or, a coupling section may be defined on inner top face of the key cap 1 before hand (in binding or snapping way), and after the elastomer 2 is positioned, jointedly dispose the key cap 1 onto the elastomer 2 and combinably joint with the positioning shaft 301 at an upper end of the link 3 to complete a pushbutton in keyboard.

Figure 7B:
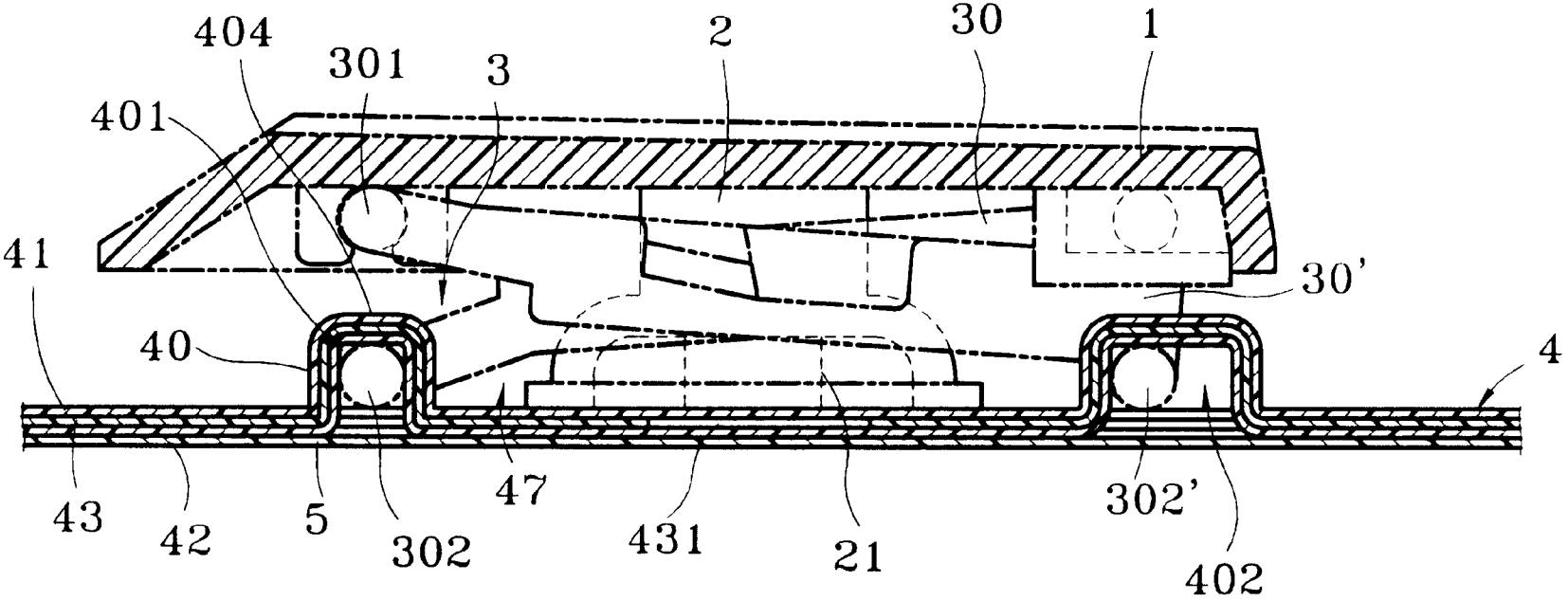
FIG. 7B is a schematic view showing action of a pushbutton in FIG. 7A when being pressed.

As shown in FIGS. 7A and 7B, when a pushbutton is pressed down, the movable shaft 302' in the relatively larger pivot-jointing hole 402 slides with respect to the movable shaft 302 in the smaller pivot-jointing hole 401 to press the elastomer 2, and consequently, a protruding piece 21 of the elastomer 2 is forced down to touch the contact point 46 in the first printed circuit layer 41 and penetrates a through hole 431 in the insulating partition layer 43 to further touch the contact point 46 in the second printed circuit layer 42 simultaneously thereby an output signal of the pressed pushbutton can be transmitted.

In cooperation with the link 3, which can be made of different materials, the flexible PCB 4 may be bent to fit the link 3 and combinably jointed together before being bound on the base 5 in compliance with process requirements.

Figure 8:
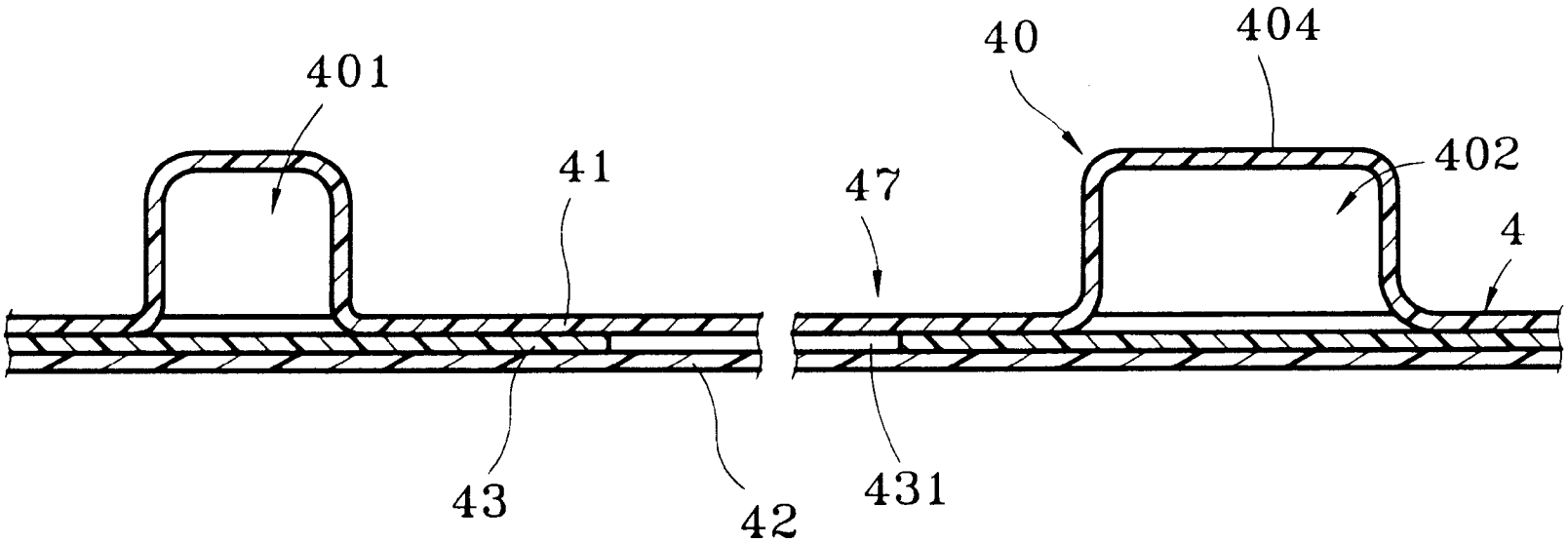
FIG. 8 is a vertical sectional view of another assembled embodiment of this invention.

In FIG. 8—a vertical sectional view of another assembled embodiment of this invention—each set of the pivot-jointing portion 40 may be formed by cutting the predetermined cutting lines 403 in the first printed circuit layer 41 to define the piece body 404, then extruded to form the pivot-jointing holes 401, 402, and bound together with the insulating partition layer 43 and the second printed circuit layer 42. The related manner of assembly-joint and embodiment are same as the abovesaid, it requires no more repeated elucidation.

Although, this invention has been described in terms of preferred embodiments, it is apparent that numerous variations and modifications may be made without departing from the true spirit and scope thereof, as set forth in the following claims.

What is claimed is:

1. An improved positioning structure of pushbutton in keyboard (2), comprising:

a base;

a printed circuit board (PCB) attached on said base having a plurality of pivot-jointing portions protrusively disposed on its surface for defining a plurality of enclosed assembly-jointing sections;

a link (bridge) combinably mounted on the assembly-jointing section of said PCB, wherein a positioning shaft and two movable shafts, which, the latter, are axially jointed with said pivot-jointing portion, are disposed at two ends of said link respectively;

an elastomer disposed on said link; and a key cap combinably mounted on said elastomer and coupled with the positioning shaft of said link;

By virtue of abovesaid components, a waterproof and thinner keyboard made in a relatively lower cost being realizable.

2. The improved positioning structure of pushbutton in keyboard (2) according to claim 1, wherein said PCB is a membrane circuit board.

3. The improved positioning structure of pushbutton in keyboard (2) according to claim 1, wherein said PCB comprises a first and a second printed circuit layer and an insulating partition layer interposed therein.

4. The improved positioning structure of pushbutton in keyboard (2) according to claim 1, wherein each set of said pivot-jointing portion by cutting predetermined cutting lines in different lengths on said PCB to define a set of piece bodies in different lengths which is then extruded to form two pivot-jointing holes in different inner diameters, wherein said movable shaft at one end of said link is pivotally mounted in a pair of relatively smaller pivot-jointing holes while said movable shaft at the other is pivotally mounted in a pair of larger pivot-jointing holes; and said movable shaft may have relative motion to said movable shaft.

5. The improved positioning structure of pushbutton in keyboard (2) according to claim 3, wherein said pivot-jointing portion is made by cutting predetermined cutting lines on said first printed circuit layer to define said piece body, then by an extrusion forming process.

6. The improved positioning structure of pushbutton in keyboard (2) according to claim 3, wherein said pivot-jointing portion is made by cutting predetermined cutting lines on a combined trinity of said first and said second printed circuit layer and said insulating partition layer to define said piece body, then by an extrusion forming process.

7. The improved positioning structure of pushbutton in keyboard (2) according to claim 4, wherein said pivot-jointing holes under said piece bodies can be formed by heat treatment, ultrasonic, hydraulic or equivalent extrusion forming methods.

* * * * *